United States Patent [19]

Miller

[11] Patent Number: 4,668,891

[45] Date of Patent: May 26, 1987

[54] PICKUP TUBE HAVING A MESH ASSEMBLY WITH FIELD MODIFYING MEANS

[75] Inventor: Louis D. Miller, Upper Leacock Township, Lancaster County, Pa.

[73] Assignee: RCA Corporation, Princeton, N.J.

[21] Appl. No.: 680,846

[22] Filed: Dec. 12, 1984

[51] Int. Cl.[4] ..... H01J 31/28

[52] U.S. Cl. ..... 313/390; 313/284

[58] Field of Search ..... 313/376, 383, 384, 390, 313/544, 269, 284

[56] References Cited

U.S. PATENT DOCUMENTS

| | | | |
|---|---|---|---|
| 2,951,962 | 9/1960 | Miller et al. | 313/89 |
| 2,963,604 | 12/1960 | Weimer | 313/66 |
| 2,967,254 | 1/1961 | Forgue | 313/65 |
| 3,123,737 | 3/1964 | Schneeberger | 315/10 |
| 3,136,916 | 6/1964 | Schaefer | 315/10 |
| 3,183,388 | 5/1965 | Townsend et al. | 313/82 |
| 3,202,857 | 8/1965 | Antoniades | 313/89 |
| 3,303,373 | 2/1967 | Alting-Mees | 313/65 |
| 3,746,917 | 7/1973 | French et al. | 313/65 R |
| 3,801,848 | 4/1974 | Van Roosmalen et al. | 313/65 A |
| 4,166,969 | 9/1979 | Hoeberechts | 313/371 |
| 4,196,369 | 4/1980 | Geus et al. | 313/365 |
| 4,264,841 | 4/1981 | Miller et al. | 313/383 |
| 4,323,814 | 4/1982 | Benner et al. | 313/390 |
| 4,347,459 | 8/1982 | Benner | 313/383 |

*Primary Examiner*—Palmer C. DeMeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

A pickup tube includes a generally cylindrical envelope having an input window at one end of the envelope and a radiation sensitive target adjacent to the input window. An electron gun is mounted in the other end of the envelope for generating an electron beam which is incident on the target. A mesh assembly is spaced from the target and in proximity therewith. The mesh assembly comprises a mesh electrode disposed between a mesh support ring and a novel mesh retaining ring. The novel mesh retaining ring has a mesh contact portion and a peripheral skirt portion which is disposed substantially orthogonally to the mesh contact portion. The skirt portion is directed toward the target for modifying the electrostatic field between the mesh electrode and the target so as to reduce beam landing error on the target and to prevent electrons, which are reflected from the target, from landing on the mesh retaining ring.

3 Claims, 5 Drawing Figures

PICKUP TUBE HAVING A MESH ASSEMBLY WITH FIELD MODIFYING MEANS

BACKGROUND OF THE INVENTION

The invention relates to a pickup tube having a target and an electron gun including a focus electrode and a mesh assembly.

U.S. Pat. No. 4,196,369, issued on Apr. 1, 1980, to Geus et al., discloses a camera tube with a conductive or secondary emission region along a portion of the tube envelope between the input window seal and the mesh electrode to stabilize the potential therebetween. The Geus et al. patent further discloses that electrons, which are dispersed by the mesh electrode or by secondary electrons generated on the mesh electrode, electrically charge the glass wall of the camera tube near the transition between the entrance window and the cylindrical glass tube comprising the sidewall of the tube envelope. The charging creates a picture disturbance which forms a pattern of, for example, annular regions containing more or less signal. The disturbance is especially noticeable at comparatively low light level.

While the Geus et al. patent addresses the problem caused by electrons from the mesh electrode striking and charging the envelope wall in the region between the input window seal and the mesh electrode, it does not address the problem of reducing shading caused by the electrons which do not have sufficient energy to land on the target and are therefore reflected back toward the cathode of the electron gun. The reflected electrons from the periphery of the target tend to land on the mesh retaining ring rather than pass through the mesh electrode into the focus electrode. These reflected electrons produce a circular dark band of shading around the outer edges of the scanned raster. This shading is most apparent when the electron beam current of the tube is set to discharge high signals, and the light level is very low, thus, resulting in the maximum number of return-beam electrons.

SUMMARY OF THE INVENTION

A pickup tube includes a generally cylindrical envelope having an input window at one end of the envelope and a radiation sensitive target adjacent to the input window. Electron beam generating and focus means are mounted in the other end of the envelope for generating an electron beam which is incident on the target. A mesh assembly is spaced from the target and in proximity therewith. The mesh assembly comprises a mesh electrode disposed between a mesh support ring and a novel mesh retaining ring. The novel mesh retaining ring has a mesh contact portion and a peripheral skirt portion which is disposed substantially orthogonally to the mesh contact portion. The skirt portion is directed toward the target for modifying the electrostatic field between the mesh electrode and the target so as to reduce the beam landing error on the target and to prevent electrons, which are reflected from the target, from landing on the mesh retaining ring.

DETAILED DESCRIPTION OF THE PREFERRED EMBODIMENT

Figure 1:
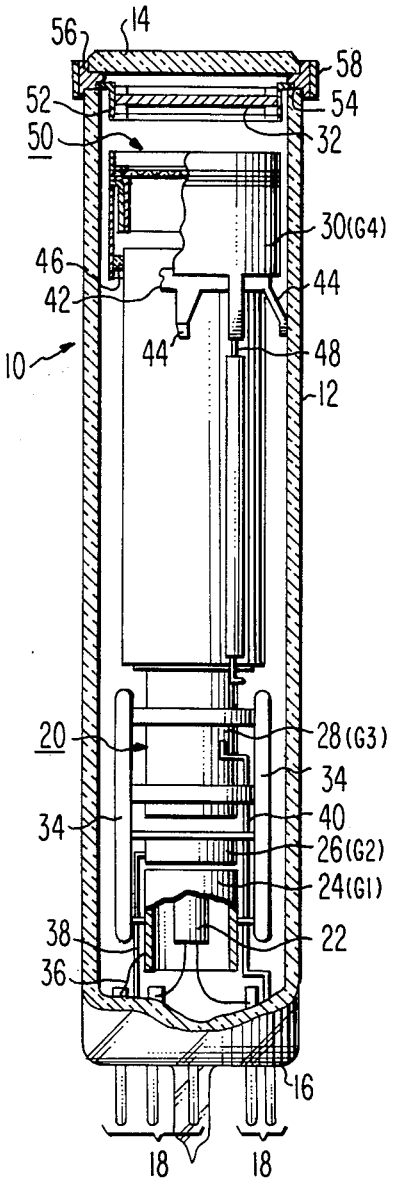
FIG. 1 is a longitudinal sectional view, partially broken away, of a novel pickup tube according to the present invention.

FIG. 1 shows a camera tube 10 of a type commercially known as a vidicon. The tube 10 comprises an evacuated, generally cylindrical glass envelope 12 closed at one end by an input window 14, which is preferably a transparent glass faceplate, and at the other end by a glass stem 16 through which lead-in pins 18 are vacuum sealed.

Positioned within the stem end of the envelope 12 is a conventional electron gun 20. The electron gun 20 comprises a thermionic cathode 22 and a control grid (or G1) electrode 24 for generating an electron beam which is focused by means of a screen grid (or G2) electrode 26, a tubular focusing (or G3) electrode 28 and a mesh support (or G4) electrode 30 toward a target 32 adjacent to the input window 14. Externally mounted deflection and focusing coils (not shown) surround the envelope 12 in a manner well known in the art. The G1 electrode 24, the G2 electrode 26 and the G3 electrode 28 are attached to a pair of insulative support rods 34 and individually attached by means of leads 36, 38 and 40 to the internal projections of the lead-in pins 18. A centering ring 42, having a plurality of snubbers 44 which contact the inside of the envelope 12, encircles the G3 electrode 28 near its distal end to center and support the electron gun 20 within the envelope. The G4 electrode 30 is insulatively attached to the G3 electrode 28 by means of an insulator 46. The attachment may be achieved by molding an insulating ring in situ between the G3 electrode 28 and the G4 electrode 30, as described in U.S. Pat. No. 4,264,841, issued to L. D. Miller et al. on Apr. 28, 1981, or by equivalent structures well known in the art. A conductor 48 electrically connects the G4 electrode 30 to the pins 18 of the stem 16. A mesh assembly 50, described in detail hereinafter, is fit into the open end of the G4 cylinder 30.

The window 14 and the target 32 are determined by the species of the incident radiation. For example, if the tube 10 is to be used as a camera tube in which photons comprise the input radiation, then the window 14 is preferably of glass, and the target 32 comprises a silicon wafer or other photoconductive material such as lead monoxide, selenium arsenic telluride, cadmium sulfide or antimony trisulfide. However, if the tube 10 is a pyroelectric vidicon, then the input window 14 may comprise germanium or some other suitable material, and the target 32 may comprise, for example, triglycine sulphate or an equivalent material. An x-ray vidicon is also within the scope of this invention, and the input window and target would comprise x-ray compatible materials as are known in the art.

In the preferred embodiment, the target 32 is supported by means of a target retainer assembly 52 which is disposed over an end 54 of the envelope 12. The window 14 is sealed to the end 54 of the envelope 12 by means of a conductive sealing material 56, such as an indium ring. A conductive contact ring 58 encircles the conductive sealing material 56.

Figure 2:
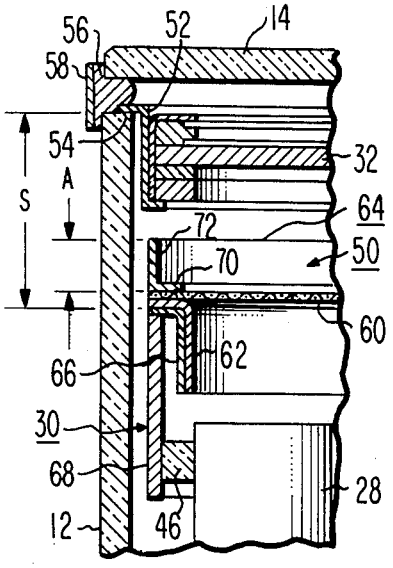
FIG. 2 is an enlarged fragmentary view of a portion of the novel pickup tube of FIG. 1.

The improved mesh assembly 50 is shown in detail in FIG. 2. The mesh assembly 50 comprises a conventional electron permeable mesh electrode 60 disposed between and secured, for example, by welding, to a conventional annular mesh support ring 62, and a novel annular mesh retaining ring 64. The annular mesh support ring 62 is configured to telescope within and engage an annular end cap 66 which is welded to the distal end of a mesh support cylinder 68. The mesh support cylinder 68 and the annular end cap 66, in combination, form the G4 electrode 30. The novel annular mesh retaining ring 64 includes a mesh contact portion 70 and a peripheral skirt portion 72 that is substantially orthogonal to the mesh contact portion 70 and is directed toward the target 32.

DISCUSSION OF RESULTS

Figure 3:
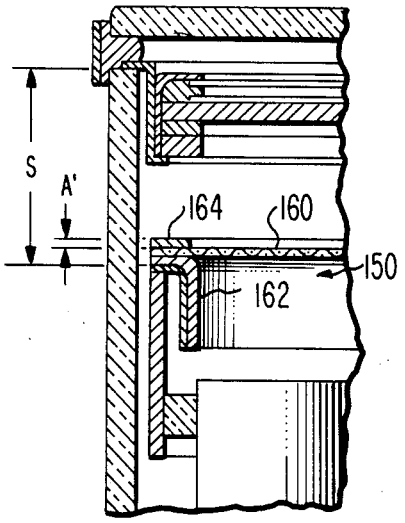
PRIOR ART Fig.3
FIG. 3 is an enlarged fragmentary view of a portion of a conventional pickup tube.

During the fabrication of the tube 10, when the stem 16 is sealed to one end of the envelope 12, the distance from the end 54 of the envelope 12 to the annular end cap 66 of the G4 electrode 30 is established at a predetermined value. This distance, referred to as the S-spacing, is shown in FIG. 2. In the preferred embodiment, the S-spacing is set at 0.140 inches (3.56 mm). Additionally, the height, A, of the novel annular mesh retaining ring 64 is 0.040 inches (1.02 mm). A conventional tube, having a prior art mesh assembly 150, is shown in FIG. 3. The mesh assembly 150 comprises a mesh electrode 160 attached between annular mesh support ring 162 and an annular mesh retaining ring 164. The principal difference between the prior art structure of FIG. 3 and the novel structure of FIG. 2 is that the novel mesh retaining ring 64 includes the orthogonal skirt portion 72. The conventional mesh retaining ring 164 of FIG. 3 has a thickness, A', of 0.005 inches (0.13 mm) and does not have a skirt portion. In order to determine the effect of the novel mesh assembly 50, nine conventional tubes and nine improved tubes, having the novel mesh assembly, were fabricated and tested. The test results for the improved tubes 10 are listed in TABLE I, and test results for the conventional tubes are listed in TABLE II.

TABLE I

| Sample Number | S-Spacing (Inches) | Height A (Inches) | % Shading Standard Beam @ 500 nA | % Shading Over Beam @ 500 μA |
|---|---|---|---|---|
| 1 | 0.140 | 0.040 | 0.0 | 0.0 |
| 2 | 0.141 | 0.040 | 0.0 | 0.0 |
| 3 | 0.142 | 0.040 | 0.0 | 0.0 |
| 4 | 0.162 | 0.040 | 2.4 | 7.2 |
| 5 | 0.159 | 0.040 | 2.3 | 5.4 |
| 6 | 0.164 | 0.040 | 1.8 | 4.2 |
| 7 | 0.184 | 0.040 | 5.2 | 10.8 |
| 8 | 0.178 | 0.040 | 5.2 | 5.9 |
| 9 | 0.180 | 0.040 | 3.8 | 6.7 |

TABLE II

| Sample Number | S-Spacing (Inches) | Height A (Inches) | % Shading Standard Beam @ 500 nA | % Shading Over Beam @ 500 μA |
|---|---|---|---|---|
| 10 | 0.142 | 0.005 | 2.0 | 3.0 |
| 11 | 0.144 | 0.005 | 3.0 | 6.0 |
| 12 | 0.142 | 0.005 | 1.8 | 4.0 |
| 13 | 0.157 | 0.005 | 3.8 | 8.5 |
| 14 | 0.156 | 0.005 | 4.9 | 10.7 |
| 15 | 0.157 | 0.005 | 3.7 | 8.0 |
| 16 | 0.181 | 0.005 | 4.8 | 10.0 |

TABLE II-continued

| Sample Number | S-Spacing (Inches) | Height A (Inches) | % Shading Standard Beam @ 500 nA | % Shading Over Beam @ 500 μA |
|---|---|---|---|---|
| 17 | 0.180 | 0.005 | 5.9 | 11.6 |
| 18 | 0.177 | 0.005 | 4.4 | 8.0 |

In TABLES I and II, the percent of shading at "standard beam" is measured with the beam current set for 500 nanoamperes (nA) of target current for a saturated signal, and the percent of shading at "over beam" is measured at an arbitrary setting of 500 microamperes (μA) of cathode current which is considered to be the "worst case" point of operation where the greatest number of electrons reflected from the target are incident on the mesh retaining ring. Shading in excess of 5 percent is unacceptable.

In TABLE I, tube samples 1–3 were fabricated with a nominal S-spacing of 0.140 inches. Each of the samples 1–3 had a novel mesh retaining ring 64 with a skirt portion 72 having a height, A, of 0.040 inches. No detectable shading could be measured in these three tubes either in standard beam or over beam operation. Samples 4–6 were similar to the aforedescribed samples 1–3 except that the S-spacing was set for a nominal distance of 0.160 inches. The average percent of shading at standard beam was about 2.16 percent, and the average percent of shading in over beam operation was about 5.6 percent. Three additional sample tubes, identified as samples 7–9, identical to the above-described samples, except that the S-spacing was set at a nominal value of 0.180 inches, were also fabricated. The average percent shading at standard beam for samples 7–9 was about 4.73 percent, and the average percent shading in over beam operation was about 7.83 percent. These average values of percent shading versus nominal S-spacing with a novel mesh retaining ring height of 0.040 inches are plotted in FIG. 4. Clearly, from FIG. 4 it can be seen that the percent shading can be minimized with an S-spacing of about 0.140 inches and a mesh retaining ring 64 having an overall height of 0.040 inches.

TABLE II shows the test results of nine conventional tubes used as a control. Each of the control tubes (samples 10–18) utilized a flat mesh retaining ring having a thickness of 0.005 inches. Samples 10–12 were constructed having a nominal S-spacing of 0.140 inches. The average shading for these samples in standard beam operation was about 2.27 percent, and the average shading in over beam operation was about 4.33 percent. Samples 13–15 were constructed having a nominal S-spacing of 0.160 inches. The resultant average shading in standard beam operation was about 4.13 percent, and the average shading in over beam operation was about 9.07 percent. Samples 16–18 were produced with a nominal S-spacing of 0.180 inches. The resultant average shading for these samples in standard beam operation was about 5.03 percent, and the average shading in over beam operation was about 9.87 percent. The average values of percent shading versus nominal S-spacing with a conventional mesh retainer ring having a height of 0.005 inches are plotted in FIG. 5.

THEORY OF OPERATION

Figure 4:
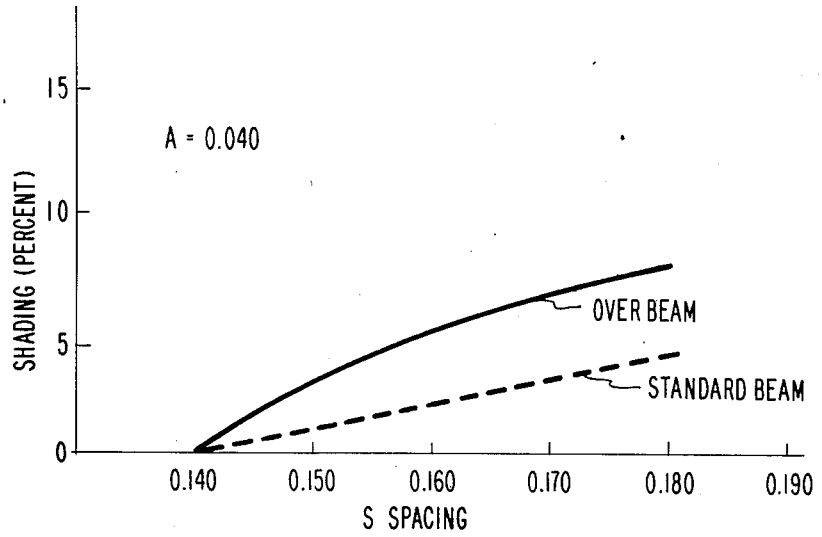
FIG. 4 shows two curves of the annular shading as a function of bulb-end to G4 support cylinder (S) spacing for a mesh retainer ring having a novel peripheral skirt.
Figure 5:
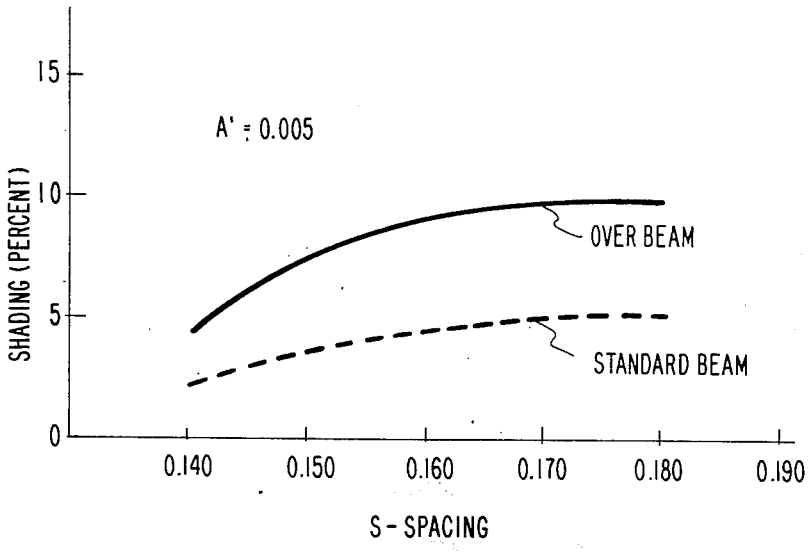
FIG. 5 shows two curves of the annular shading as a function of bulb-end to G4 support cylinder (S) spacing for a conventional mesh retainer ring.

The normal operating voltages for the tube 10 in a camera are as follows: G1, −60 volts; G2, 300 volts; G3, 260 volts; and G4, 360 volts. The target 32 typically operates at 9 volts. It is well known in the art that for optimum signal uniformity in television camera tubes, it is necessary for the electron beam from the electron gun 20 to land perpendicular to the target 32 at all points on the target. The error due to the electron beam not landing perpendicular to the target is referred to as beam-landing error. Beam-landing error may be minimized by adjusting the focus field in the mesh-target region of the tube, by varying the ratio of the G3 focus voltage to G4 mesh voltage, and by changing the external deflection coil location and design. FIGS. 4 and 5 indicate that a decrease in S-spacing, i.e., in the ultimate mesh-target distance, decreases the percent of shading on the scanned raster. However, there is a limit to the minimum distance between the mesh and target. This minimum distance is the distance at which a mesh moire pattern occurs. Applicant has determined that by adding a skirt portion 72 to the mesh retaining ring 64, the electron optics of the mesh-target region can be changed without creating a moire pattern. The skirt portion 72 extends toward the target 32 and modifies or changes the electrostatic field between the mesh electrode 60 and the target 32 to improve the beam landing on the target, i.e., the beam landing error is reduced. Additionally, the skirt portion 72 also bends the electron beam that is reflected from the target after the charge on the target is re-established and causes the return-beam to pass harmlessly through the mesh electrode 60 into the G3 electrode 28 rather than strike the mesh retainer ring. This theory of operation is supported by the test results listed in TABLES I and II which show that for various values of S-spacing, the percent of shading for the tubes listed in TABLE I, which have the novel mesh retaining ring 64, is less than for the tubes of TABLE II having comparable S-spacings but a conventional mesh retainer ring.

For pickup tubes having operating voltages, target geometries and focusing fields different from those described herein, it is necessary to modify the electron optics by changing the configuration of the novel mesh retaining ring 64, more specifically, the skirt portion 72, to minimize beam landing error on the target 32.

What is claimed is:

1. In a pickup tube having a generally cylindrical envelope, an input window at one end of said envelope, a radiation sensitive target adjacent to said input window, electron beam generating and focusing means in the other end of said envelope for generating an electron beam which is incident on said target and a mesh assembly spaced from said target and in proximity therewith, the improvement wherein said mesh assembly comprises a mesh electrode disposed between a mesh support ring and a mesh retaining ring, said mesh retaining ring having a mesh contact portion and a peripheral skirt portion disposed substantially orthogonally to the mesh contact portion, said skirt portion being directed toward said target for modifying the electrostatic field between said mesh electrode and said target so as to reduce the beam landing error on said target and to prevent electrons which are reflected from said target from landing on said mesh retaining ring.

2. In a pickup tube having a generally cylindrical envelope, a faceplate at one end of said envelope, a photoconductive target adjacent to said faceplate, electron beam generating and focusing means in the other end of said envelope for generating an electron beam which is incident on said target and a mesh assembly spaced from said target and in proximity therewith, the improvement wherein said mesh assembly comprises a mesh electrode disposed between an annular mesh support ring and an annular mesh retaining ring, said mesh retaining ring having a mesh contact portion and a peripheral skirt portion disposed substantially orthogonally to the mesh contact portion, said skirt portion being directed toward said photoconductive target for modifying the electrostatic field between said mesh electrode and said target so as to reduce the beam landing error on said target and to prevent electrons which are reflected from said target from landing on said mesh retaining ring.

3. In a pickup tube having a generally cylindrical envelope, a faceplate at one end of said envelope, a photoconductive target adjacent to said faceplate, and electron beam generating and focusing means within said envelope and spaced from said target for generating and focusing an electron beam, said generating and focusing means comprising, in the order named, a cathode, a control grid electrode, a screen grid electrode, a focusing electrode and a mesh support electrode having a mesh assembly attached to one end thereof, said mesh assembly being spaced from said target and in proximity therewith, the improvement wherein said mesh assembly comprises a mesh electrode disposed between an annular mesh support ring and an annular mesh retaining ring, said mesh retaining ring having a mesh contact portion and a peripheral skirt portion disposed substantially orthogonally to the mesh contact portion, said skirt portion being directed toward said photoconductive target and having a height sufficient to modify the electrostatic field between the mesh electrode and said target so as to reduce beam landing error on said target, the height of said skirt portion and the spacing from the one end of said envelope to the one end of said mesh support electrode being sufficient to prevent electrons which are reflected from said target from landing on said mesh retaining ring.

* * * * *